United States Patent [19]

Netto

[11] Patent Number: 4,983,047

[45] Date of Patent: Jan. 8, 1991

[54] ENVELOPE WITH CLOSURE AND SEAL DEVICE

[76] Inventor: Eduardo D. L. C. Netto, Rua São Luiz Gonzoga, 912, 20910 Rio de Janeiro, Brazil

[21] Appl. No.: 429,124

[22] Filed: Oct. 30, 1989

Related U.S. Application Data

[63] Continuation-in-part of Ser. No. 268,985, Nov. 9, 1988, abandoned.

[30] Foreign Application Priority Data

Nov. 26, 1987 [BR] Brazil ..... PI8706409

[51] Int. Cl.[5] ..... B65D 33/34

[52] U.S. Cl. ..... 383/5; 383/68; 383/79; 383/92; 24/30.5 R; 24/543; 24/704.1; 292/318

[58] Field of Search ..... 383/5, 68, 78, 79, 92; 24/30.5 R, 30.5 P, 543, 704.1; 292/314, 318

[56] References Cited

U.S. PATENT DOCUMENTS

| | | | |
|---|---|---|---|
| 1,155,375 | 10/1915 | Shannon | 383/68 |
| 2,843,309 | 7/1958 | Wheeler | 383/5 |
| 3,727,829 | 4/1973 | Hüni | 383/86 X |
| 4,042,267 | 8/1977 | Clinch et al. | 24/30.5 R X |

FOREIGN PATENT DOCUMENTS

| | | | |
|---|---|---|---|
| 2590236 | 5/1987 | France | 383/5 |
| 2171665 | 9/1986 | United Kingdom | 383/5 |

*Primary Examiner*—Stephen Marcus
*Assistant Examiner*—Jes F. Pascua
*Attorney, Agent, or Firm*—Beveridge, DeGrandi & Weilacher

[57] ABSTRACT

A security envelope for transporting confidential papers or money is disclosed having a high degree of security, being easy to close and seal as well as simple to manufacture. The envelope of the invention is provided with a closure and seal device having a first part extended along one side of the opening thereof, external of the envelope, such part being formed with a series of long pins distributed along its length. The pins pass through both sides of the envelope along a line adjacent to the opening to be received and locked in locking sockets formed in a second part extended along the opening on the other side of the envelope. The two parts of the closure and seal device are preferably hinged together along corresponding londitudinal edges so that when closed, the hinge lies along the opening so as to prevent access to the interior of the envelope through the spaces between the pins.

13 Claims, 6 Drawing Sheets

ENVELOPE WITH CLOSURE AND SEAL DEVICE

This is a continuation-in-part of U.S. patent application Ser. No. 07/268,985, filed Nov. 9, 1988, now abandoned.

BACKGROUND OF THE INVENTION

There has been a long felt need for an envelope that may be closed and sealed in a totally tamper-proof manner, that can be opened and closed again without leaving clear traces of violation. One example is the handling and transport of money. Every time the money passes from one person to another, even within the same banking establishment, it has to be counted. Otherwise the eventual loss of part of the money cannot be attributed to any given event. The solution to this problem would obviously be the closure of the counted money in a sack or envelope that can be sealed and the opening thereof only at the final destination. However, in view of the enormous volume of money that is handled daily, not only security is required. It is also essential that the closure and sealing system be simple to handle and operate. A combination between a high degree of security and simplicity of operation is therefore essential for such solution to be put into practice.

A plastic envelope for the transport of money or confidential documents is already known, which is closed by means of an adhesive which supposedly prevents the re-opening of the envelope without visably adulterating the material thereof. Although such a product is undisputably easy to close, unfortunately it is relatively simple to soften the adhesive with solvent, open the envelope and then close it again, it being sufficient to evaporate the solvent for the adhesive to return to it original condition without leaving any visible sign of violation.

An object of the present invention is therefore to provide a new solution to the problem whereby, by means of an equally simple operation, money or confidential documents may be placed and sealed within a totally tamper-proof envelope so that there is no necessity to check the contents of the envelope, at the intermediate phases of its transport, but rather only at its final destination.

According to the present invention an envelope with closure and seal means comprises an envelope having first and second opposed planar sides and a closure and seal device having a first part extended substantially along said opening externally of the first side, the first part being formed with a series of locking pins distributed along and normal to its length, each pin passing through a corresponding pair of orifices, one on each said side of the envelope. The closure and seal device also has a second part formed with a corresponding series of locking socket formations for the pins and adapted to be placed externally of said second side of the envelope, substantially along the opening, for the reception and locking of the pins in a closed and sealed configuration of the envelope. Means are also provided along the whole length of and folded over said opening in the closed and sealed configuration and thus maintained by the locking of the pins in the socket formations.

When a very high degree of security is desired for the transport of money, the pilfer-proof characteristic of the seals may be ensured when the socket formations include internal locking teeth engagable behind the heads formed on the pins and, furthermore, in the closed and sealed configuration, there is no access to said teeth from the outside. This may conveniently be obtained when the external part of each socket formation, in such configuration, presents an axial opening substantially filled by the head of the respective locking pin.

The two parts of the closure and seal device may be molded from plastic material as a single piece and hinged together along corresponding logitudinal edges, the hinge region being extended along the opening of the envelope and comprising the means folded over the opening in the closed and sealed configuration.

Alternatively, or even in addition, the first side of the envelope may include a part or flap extended beyond the opening of the envelope, it being formed along its free transverse edge with a series of orifices so that such flap may be doubled over the opening of the envelope and penetrated by the pins before they are locked in the socket formations, thus defining said means folded over the opening in the closed and sealed configuration.

According to a further aspect of the present invention a closure and seal device having the features mentioned above is provided at such end of its first part with a foldable tongue and a catch formation spaced therefrom to catch and hold a free end of the surface of the first part. This not only fixes the device to the envelope but also, especially when the tongues are extended longitudinally away from the ends of the first part to be doubled back over it, prevents any possibility of access to the interior of the envelope from the ends of its transverse opening.

When, in one embodiment, the device is modular, the tongues will be provided only on the outer ends of the first and last modules, to be joined to the adjacent module with at least one of the pins of one of the modules passing through an orifice on the other module.

The above and further characteristic aspects of the present invention will be more clearly understood from the following description given merely by way of example, in which reference will be made to the drawings, in which.

Figure 1:
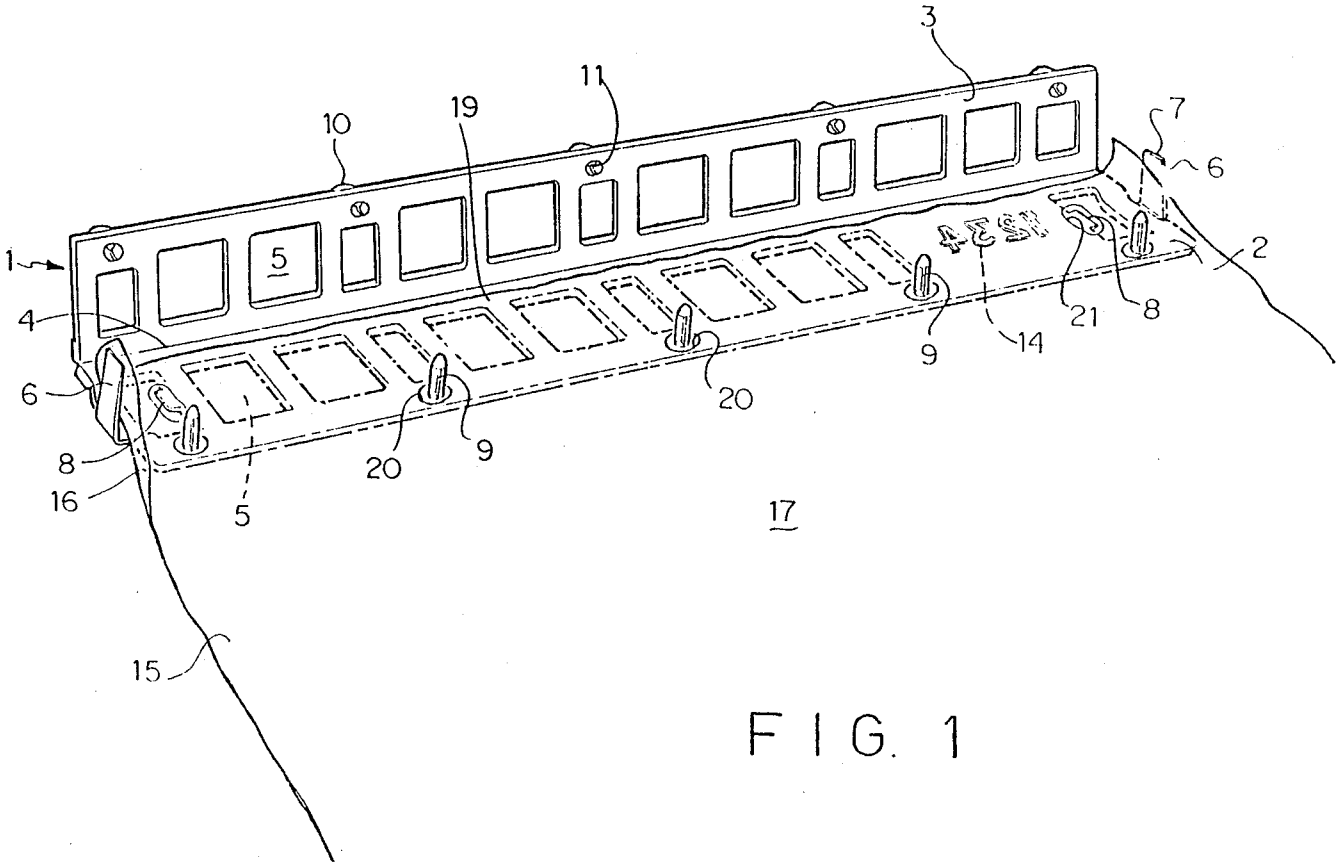
FIG. 1 is a perspective view of an envelope with a closure and seal device in accordance with the present invention, in a first phase of mounting.

Referring now to FIGS. 1 to 4 of the drawings, a closure and seal device 1 in accordance with this invention comprises two elongated rectangular parts 2 and 3 joined to each other by a hinge line 4 of reduced thickness. Device 1 is molded in plastic as a single piece and windows 5 are opened in parts 2 and 3 with the simple purpose of reducing the quantity of plastic material used in the manufacture of the product.

Each end of part 2 is formed with fixing means in the form of an axially directed tongue 6 which may be folded about its end connected to the rest of part 1, so that its free end 7 may be caught under pressure behind a catch formation an ear 8 formed in the first window 5.

Adjacent and along the longitudinal free edge of part 2, locking pins 9 are formed for being received and locked in corresponding socket formations 10. The type of seal formed by each pin-socket pair is well known, although it generally has a relatively low degree of security due to the fact that the socket comprises a cylinder open at its two ends and formed internally with locking teeth, permitting a would-be violator to introduce a needle or small through one of the ends of the cylinder for the purpose of freeing the teeth from their fitment behing the head of the pin. In the case of the present invention, the external end of each socket formation has its internal diameter reduced so as to be approximately that of the circle defined by the free ends of the teeth 11 so that opening 12 at such end is substantially filled—in the closed position—by the front end of the head 13 of pin 9. When the envelope with the device is to be used for transporting money, this characteristic is of extreme importance since it makes a seal normally having a lower degree of security, one of high security, thus permitting the sealing mechanism to be outside the envelope without compromising the security of the system.

The more closed the outer end of the socket, the better the security of the device but this should not be done in prejudice to the quality of finishing of the product (for example, by applying heat and pressure to the end of the socket) since it sould then be difficult to check whether the closure of the end of the socket had been effected during manufacture of the part or later by a violator. In practice, it is preferable that the socket be manufactured with a cylindrical shape and then later its end deformed by using a rotary tool having an axial conical recess applied under pressure thereagainst. This results in a perfect finishing which was obviously made during manufacture of the part.

Preferably, and as shown in the drawings, part 2 has a surface 14 for being individualized, preferably numbered, as shown. When one desires a high degree of security, numbering should be molded in high relief of the part, it being highly recommended that the plastic of the piece be transparent and that the numbering be molded on its non-exposed face, being visible therethrough.

The envelope 15 to be used with the device 1 is also made of plastic, having first and second opposite planar sides 16 and 17, a closed end and an end with a transverse opening 19 to be closed and sealed by the device. Adjacent and along the edges of opening 19, sides 16 and 17 are formed with respective series of equally spaced small orifices 20 for the passage of pins 9 in part 1 of the device. Sides 16 and 17 are also formed with small slits 21 for the passage of the ends of tongues 6 which are also in part 1.

As best seen in FIG. 1, device 1 is mounted on envelope 15 with pins 9 passing first through orifices 20 in side 16 and then through orifices 20 in side 17. Apart from this, the fixture itself of the device to the envelope is effected by means of tongues 6, each one being folded backwardly around a side edge 22 of the envelope, with its free end passing through the superimposed slits 21 and caught under pressure behind one of the ears 8.

The filling and closure of the envelope thus configured are extremely simple. Firstly, the edge of opening 19 in the second side 17 of the envelope, is lifted and disengaged from pins 9, thereby giving access to the interior for the placement therein of the documents or money to be transported. After this, by folding the ends of part 1 backwardly about its center, the said edge of opening 19 is stretched along part 1 and pins 9 automatically penetrate orifices 20 after which it is sufficient merely to fold part 3 of device 1 about the hinge line 4 to close opening 19 and super-impose it over part 2 with the end of envelope 1 caught therebetween. Finally parts 2 and 3 are squeezed together so that all pins 9 penetrate the respective socket formations 10, thus closing and sealing the device 1 and consequently the envelope 15.

Figure 2:
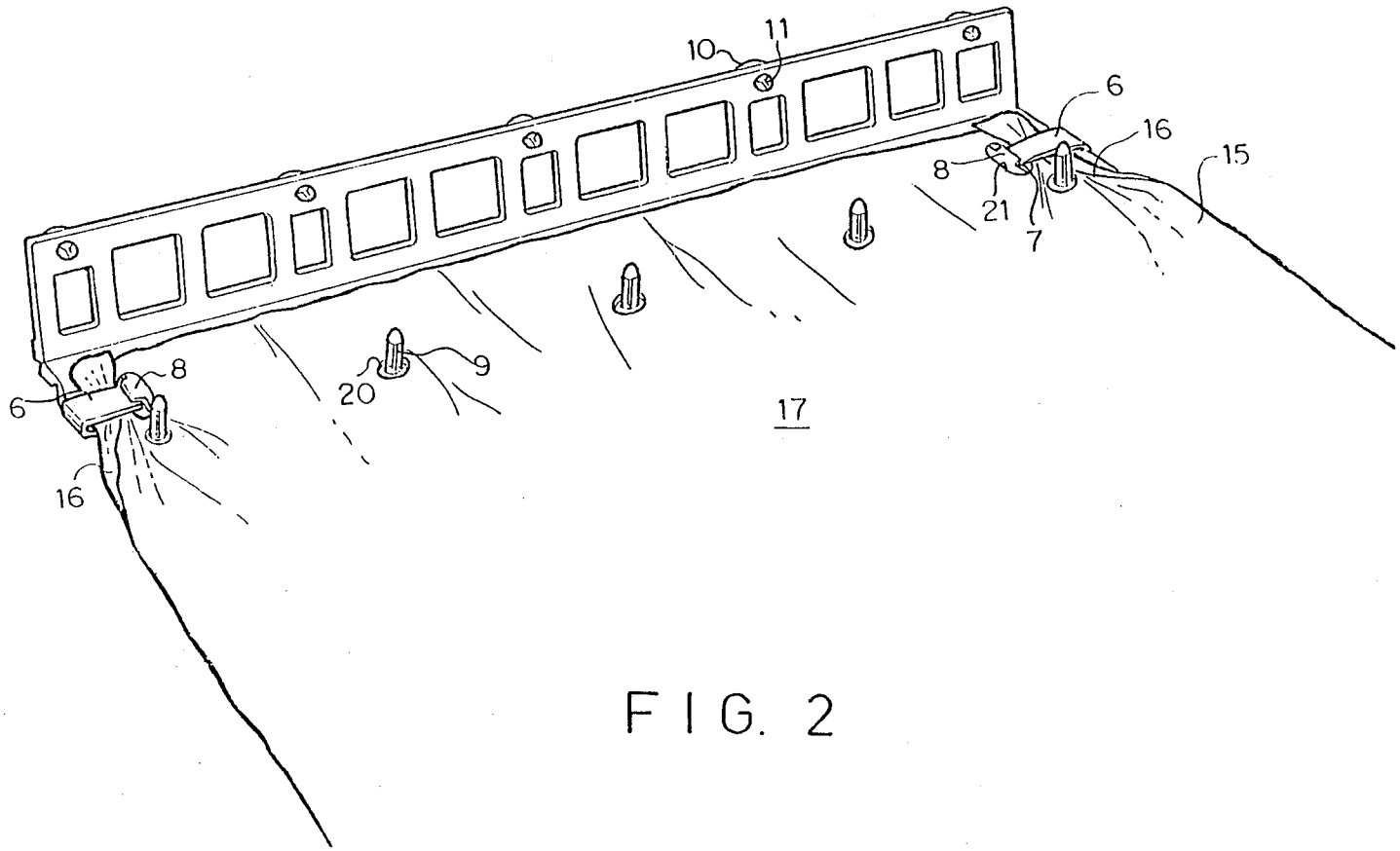
FIG. 2 shows the same envelope with the mounting of the device already completed.
Figure 3:
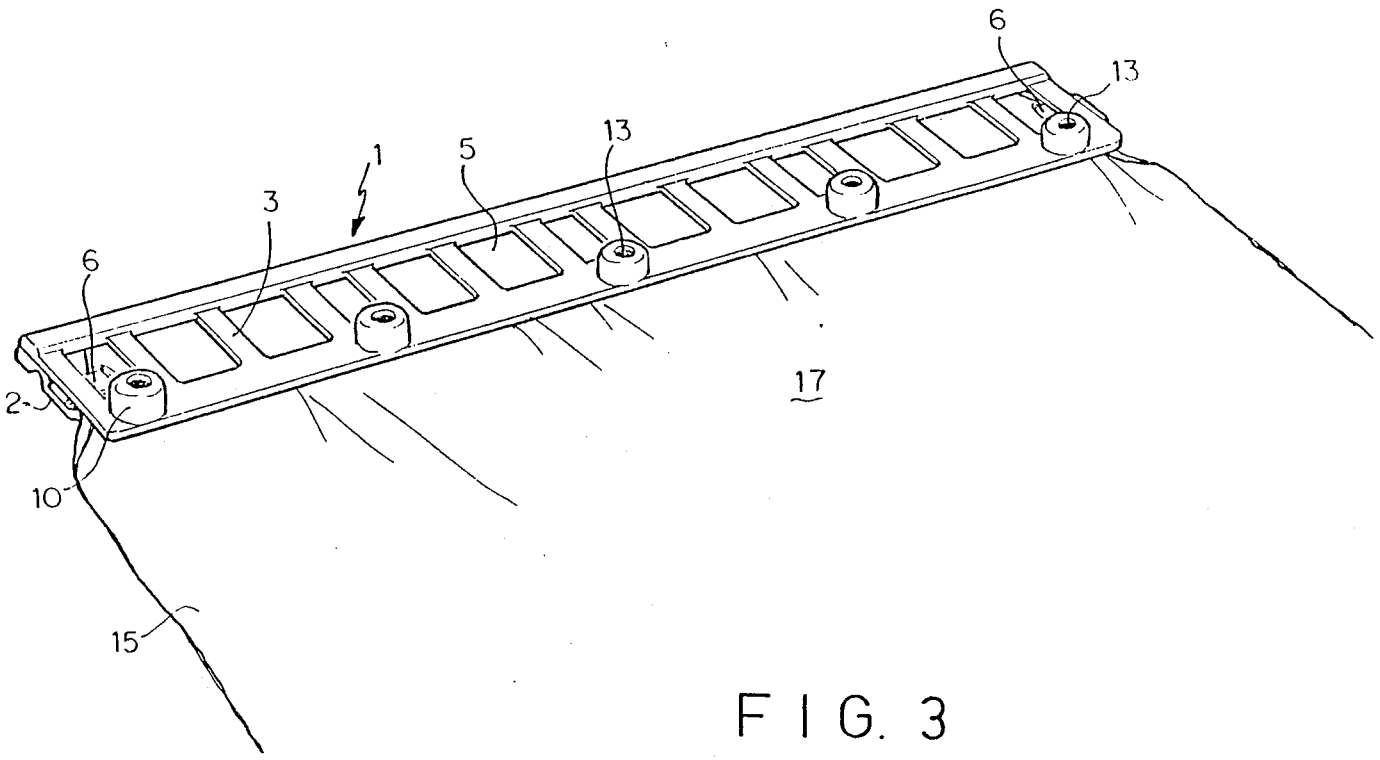
FIG. 3 is a similar perspective view but with the envelope and device in the closed and sealed configuration.
Figure 4:
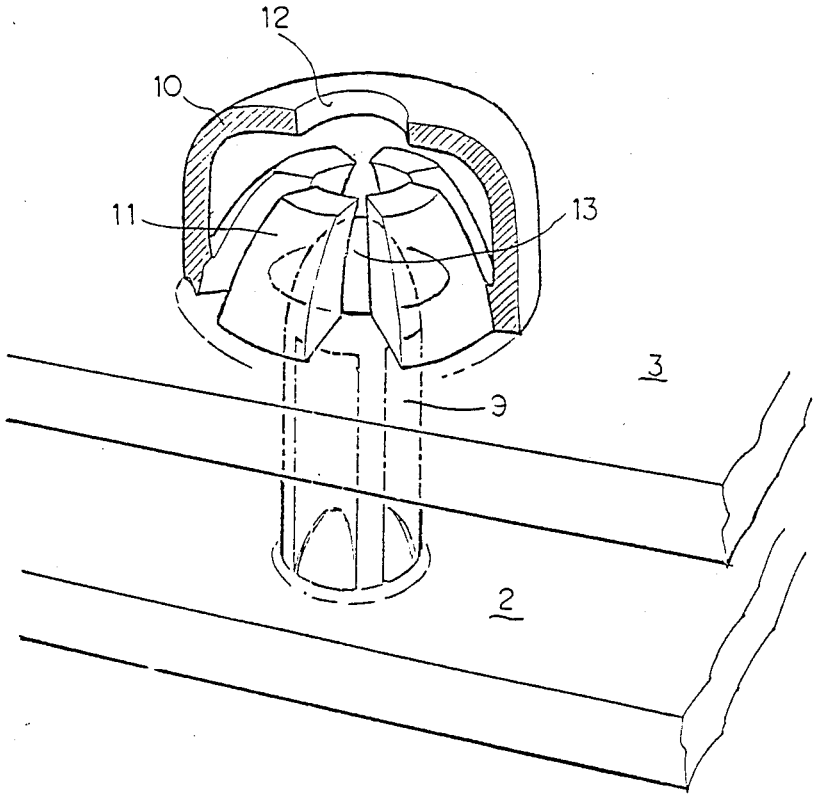
FIG. 4 shows a detail, partially in section, of the sealing system.

The device 1 shown in FIGS. 1 to 3 is a single part extending totally across the width of envelope 15. There is, however, a technical limitation with regard to the length of device 1 since, if the thickness of the device is not increased, injection molding cannot be effected for manufacturing parts having greater length.

Figure 5:
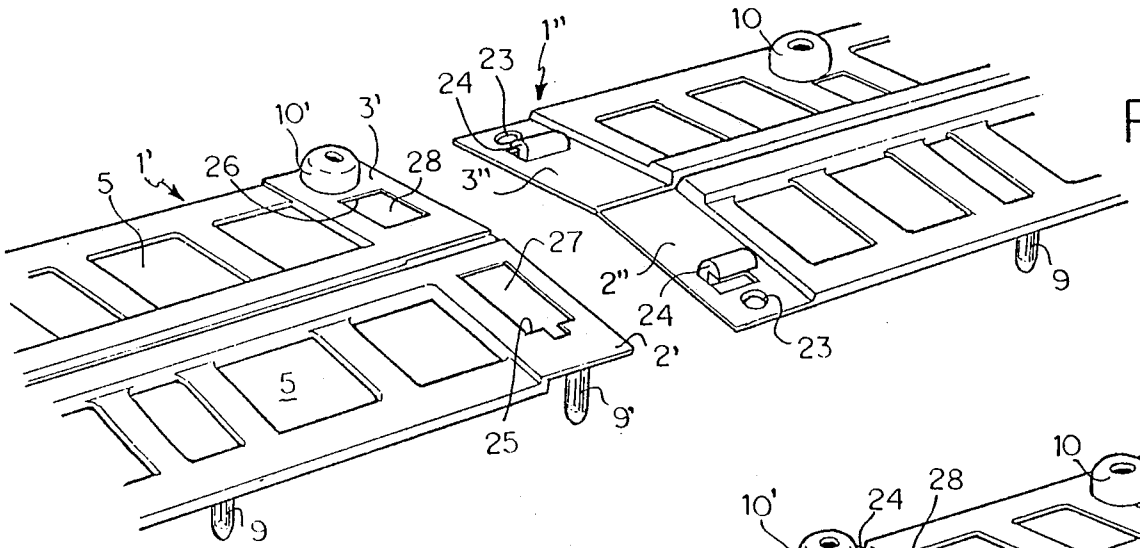
FIG. 5 is a perspective view of a detail of a second embodiment with a modular closure and seal device, prior to the connection of two adjacent modules.
Figure 6:
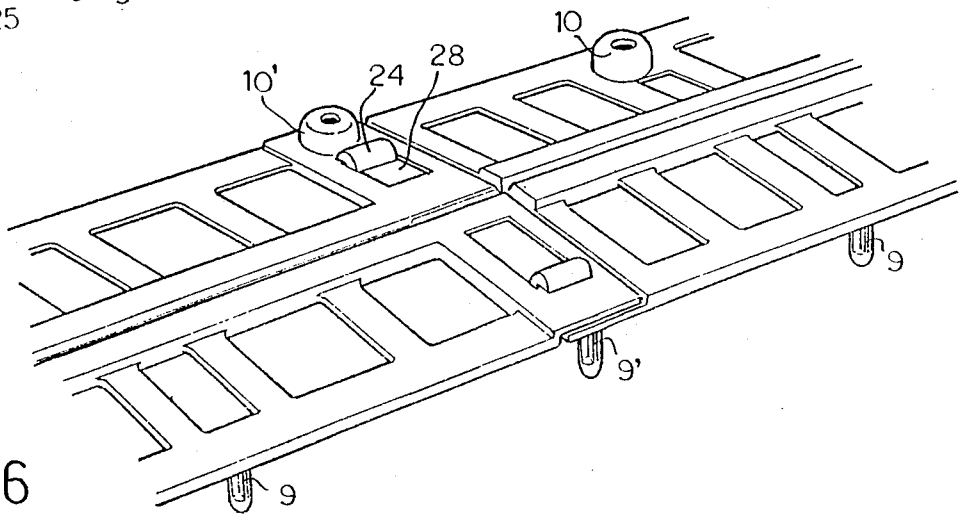
FIG. 6 is a perspective view, similar to FIG. 5, but with the two modules connected to each other.

Consequently, FIGS. 5 and 6 show a closure and seal device of a modulated type for use on envelopes having larger openings.

FIG. 5 shows the ends to be joined of two modules 1' and 1''. The ends shown obviously do not have the tongues 6 of device 1 of FIGS. 1 to 3, only the ends of the last two modules on the side edges of the envelope being provided with such tongues. The end of module 1' shown in FIG. 5 is provided with a pin 9' in its end part 2' and with a locking socket 10' in its part 3'. The end of module 1'' shown in FIG. 5, however, is formed with two orifices 23 in its parts 2'' and 3'', respectively, for the passage of said pin 9'. Parts 2'' and 3'' are also formed with two hooks 24 adjacent such orifices 23 and serving to engage themselves under end edges 25 and 26 of two additional windows 27 and 28 formed in the ends of the respective parts 2' and 3' of module 1'.

FIG. 6 shows the two modules 1' and 1'' having their ends joined with pin 9' passing through orifice 23 in part 2'' of module 1'' and with hooks 24 catching edges 25 and 26 of windows 27 and 28 in module 1'.

The closure and seal device made of two or more modules 1', 1'' may be used to close an envelope whose opening has a length of the modules used. It will also be observed that, in the closed and sealed configuration, pin 9' passes through the orifices 23 of the adjacent module before entering the locking socket 10'. In other words, the modules are sealed to each other and consequently there is no necessity to individualize or number (as shown in FIG. 1) more than one of the modules. Apart from this, FIGS. 5 and 6 show how it is extremely simple to join the adjacent modules.

Although not illustrated in the drawings, the degree of security of the arrangement can be further increased if side 16 of the envelope shown in FIGS. 1 and 3 continues on in the form of a flap beyond opening 19, such flap having the same size as part 3 of device 1 and being formed adjacent and along its upper edge with a series of orifices corresponding to orifices 20 in parts 1 and 2, for the passage of pins 9. Thus, opening 19 of envelope 15, in the closed and sealed configuration, would be closed not only by the part of device 1 in the region of hinge 4, but also by such flap on side 16.

Furthermore, when envelope 15 is formed with a flap on side 16 as mentioned above, the device 1 itself could have its parts 2 and 3 hinged to each other at one end— thus eliminating the presence of one of the tongues 6—instead of being hinged to each other along their length.

Figure 7:
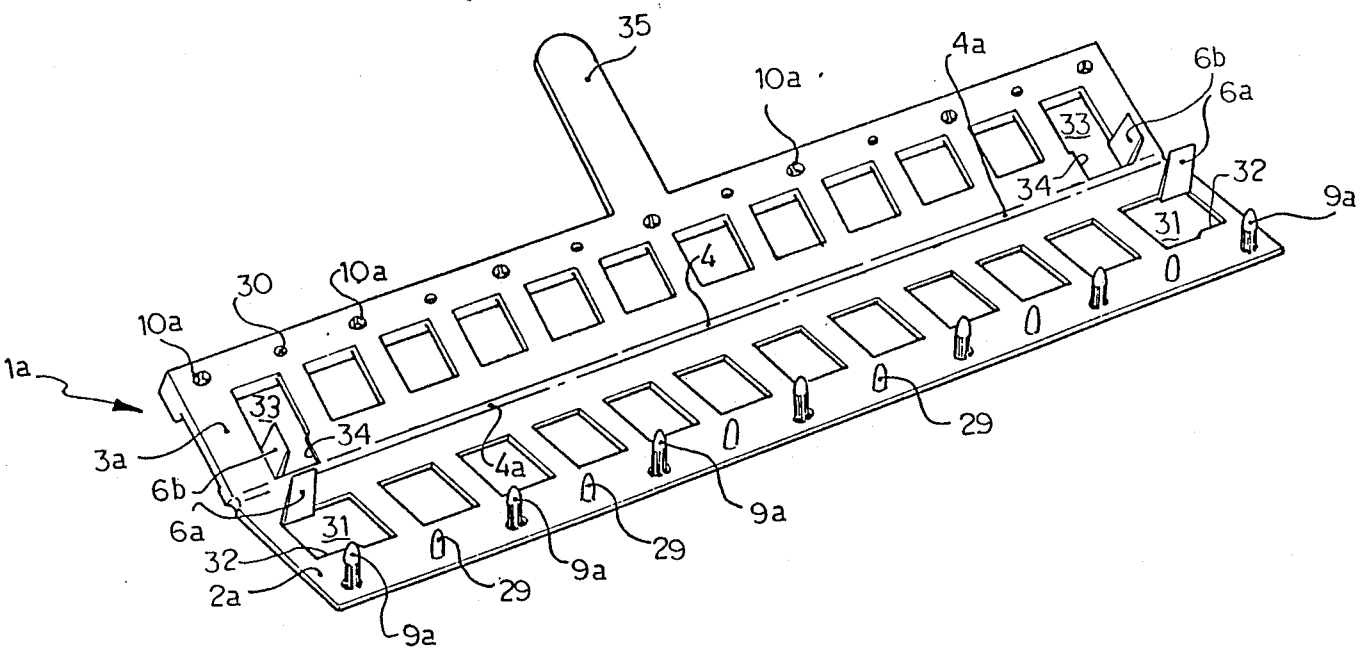
FIG. 7 is a perspective view of a further embodiment of the closure and seal device.

FIG. 7 shows a second embodiment of a closure and seal device according to the invention. This device 1*a*, similar to device 1 of FIGS. 1 to 3, comprises a first and second substantially planar rectangular elongated parts 2*a* and 3*a* of a plastic material joined together by a hinge portion 4*a*. Part 2*a* is provided with the locking pins 9*a* and part 3*a* with the locking socket formations 10*a*. In this case, however, the pins 9*a* are alternated with smaller positioning pins 29 and the locking socket formations 10*a* are correspondingly alternated with positioning orifices 30. The pins and orifices merely serve a positioning function and have no greater relevance to the present invention.

The device 1*a* is provided at the ends of part 2*a* with fixing tongues 6*a* and windows 31 having tongues catching edges 32 so that the tongues may be doubled over and caught in such a position in a manner analogous to that of tongues 6 and ears 8 in the device 1. The difference is that, instead of being extended longitudinally away from the ends of part 2 as in FIG. 1, tongues 6*a* are transverse and formed adjacent and inwardly of the ends of part 2*a*. As a result, the envelope to be used with device 1*a* will have to be formed with a pair of slits adjacent each end for passage of the corresponding tongue 6*a* so as effectively to prevent any access to the interior of the envelope from the ends of its opening.

The device 1*a* is also suitable for use with an envelope having a flap as an extension of side 16 (FIGS. 1 to 3), as mentioned above. In such a case, it is advisable—in order to simplify the operation of closure of the envelope—to fix the flap to the second part of the device. Thus, the second part 3*a* of device 1*a* is provided with tongues 6*b* and windows 33 having tongue catching edges 34, the tongues 6*b* being passed in use through appropriate slits in the flap of the envelope before having their ends caught under edges 34.

Device 1*a* is also provided on part 3*a* with an identifying tab 35 as an alternative to the use of a surface of one of the main parts of the device for the placement of individualization marks.

These and other modifications are embraced by the concept of the present invention, the scope of which should be limited only by the terms of the following claims.

I claim:

1. Envelope with closure and seal device comprising an envelope having first and second opposite planar sides and a transverse opening adjacent one end, and a closure and seal device having a first part extended substantially along said opening externally of said first side, said first part being formed with a series of upstanding locking pins distributed therealong, each pin passing through a corresponding pair of orifices, one in each said side of the envelope, the closure and seal device also having a second part formed with a corresponding series of locking socket formations for said pins, said second part being adapted to be placed externally of said second side of said envelope and substantially along said openings for receiving and locking said pins in a closed and sealed configuration of the envelope, means also being extended along the whole length of, and folded over said opening in said configuration and maintained in such position by the locking of said pins in said socket formation, each said socket formation including internal locking teeth co-operable behind a head formed on a corresponding one of said pins and having an outer part which, in said closed and sealed configuration, has an axial opening substantially filled by said head whereby there is no access to said teeth from the outside in said closed and sealed configuration.

2. Envelope with closure and seal device according to claim 1, in which said first part is provided at each end with fixing means fixing said first part said envelope, each fixing means passing around a side edge of said envelope in a position adjacent said opening in said envelope.

3. Envelope with closure and seal device according to claim 2, in which each said fixing means comprises a tongue formed integrally with said first part of said closure and seal device, said tongue being folded around said side edge so that a free end of said tongue passes through slits formed in said second and first sides of said envelope, to be caught under pressure by a suitable formation on said first part.

4. Envelope with closure and seal device according to claim 3, in which said first and second parts of said closure and seal device are molded from plastic material as a single piece, said parts being hinged together along corresponding longitudinal edges to define a hinge region, said hinge region, being extended along said opening in said envelope and comprising said means folded over said opening in said closed and sealed configuration.

5. Envelope with closure and seal device according to claim 4 in which said device comprises a plurality of modules, each said module having first and second parts and one end to be connected to an adjacent end of another said module, said one end of one said module having a locking pin in its said first part and a locking socket formation for said pin in its said second part, and the adjacent end of said another module having an orifice in its said first part through which passes said pin and a corresponding orifice in its said second part for the passage of said pin, in said closed and sealed configuration, before said pin enters said locking socket formation.

6. Envelope with closure and seal device according to claim 5, further comprising a pair of hooks on said end of one of said modules and formations co-operable with said hooks on the adjacent end of said adjacent module.

7. Closure and seal device for an envelope comprising first and second substantially planar rectangular elongated parts of plastics material, each said part having first and second ends and first and second longer side edges, said first longer side edges being joined together by a continuous hinge portion extended completely along said side edges, said first part having a first planar surface provided with a plurality of spaced locking pins upstanding therefrom and said second part being formed with a corresponding plurality of locking formations for receiving and locking said pins therein when said parts are folded over each other about said hinge portion, each said first and second ends of said first part being provided with a foldable tongue means and a catch formation spaced therefrom to catch and hold a free end of said tongue means in a folded over position substantially super-imposed on said first planar surface of said first part.

8. Closure and seal device according to claim 7, in which said tongue means extend longitudinally away from said first and second ends of said first part, respectively.

9. Closure and seal device for an envelope comprising first and second substantially planar rectangular elongated parts connected together by a hinge portion and formed of plastics materials, each said part having first and second ends and first and second longer side edges, said first part having a first planar surface provided with a plurality of spaced locking pins upstanding therefrom and said second part being formed with a corresponding plurality of locking formations for receiving and locking said pins therein when said parts are folded over other about said hinge portion, said first end of said first part being provided with a foldable tongue means and a catch formation spaced therefrom to catch and hold a free end of said tongue means in a folded over position substantially superimposed on said first planar surface of said first part, and said second ends of said first and second parts being provided with means permitting said second ends to be joined to an adjacent closure and seal device of a similar type in a configuration in which at least one of said pins of one of said devices passes through an orifice in the other said device.

10. Envelope with closure and seal device according to claim 9 in which said device comprises a plurality of modules, each said module having first and second parts and one end to be connected to an adjacent end of another said module, said one end of one said module having a locking pin in its said first part and a locking socket formation for said pin in its said second part, and the adjacent end of said another module having an orifice in its said first part through which passes said pin and a corresponding orifice in its said second part for the passage of said pin, in said closed and sealed configuration, before said pin enters said locking socket formation.

11. Envelope with closure and seal device according to claim 10, further comprising a pair of hooks on said end of one of said modules and formations co-operable with said hooks on the adjacent end of said adjacent module.

12. Envelope with closure and seal device comprising an envelope having first and second opposite planar sides and a transverse opening adjacent one end, and a closure and seal device comprising a series of modules, each said module having a first part extended substantially along said opening externally of said first side, said first part being formed with a series of upstanding locking pins distributed therealong, each pin passing through a corresponding a pair of orifices, one in each said side of the envelope, each said module also having a second part formed with a corresponding series of locking socket formations for said pins, and a first said module having a first end to be connected to an adjacent second end of a second said module, said second end being formed with one pin receiving orifice in each of its said first and second parts and positioned so that the second end of said second module may be superimposed on said first end of said first module with a last pin of said series of pins in said first module passing through both of said pin receiving orifices in said second module prior to entering its corresponding said socket formation, said second parts of said modules being adapted to be placed externally of said second side of said envelope and substantially along said openings for receiving and locking said pins in a closed and sealed configuration of the envelope, means also being extended along the whole length of, and folded over said opening in said configuration and maintained in such position by the locking of said pins in said socket formations.

13. Envelope with closure and seal device according to claim 12, further comprising a pair of hooks on said second end of said second module, and formations co-operable with said hooks on said first end of said first module.

* * * * *